United States Patent [19]

Johnson

[11] 3,932,913

[45] Jan. 20, 1976

[54] PIVOT ASSEMBLY

[75] Inventor: Larry K. Johnson, Morrison, Ill.

[73] Assignee: Lawrence Brothers Inc., Sterling, Ill.

[22] Filed: Jan. 9, 1975

[21] Appl. No.: 539,789

Related U.S. Application Data

[60] Division of Ser. No. 449,321, March 11, 1974, which is a continuation-in-part of Ser. No. 352,878, April 20, 1973, abandoned.

[52] U.S. Cl. ..... 16/130

[51] Int. Cl.[2] ..... E05D 7/04

[58] Field of Search ..... 16/129–134, 16/151, 153, 169, 176, 178, 179, 185; 160/118, 151, 87 R, 93 R, 95 R, 206

[56] References Cited

UNITED STATES PATENTS

| | | | |
|---|---|---|---|
| 2,530,331 | 11/1950 | Hubbs | 16/151 X |
| 2,854,687 | 10/1958 | Baldauf | 16/130 |
| 2,987,756 | 6/1961 | Hollansworth | 16/151 |
| 3,152,355 | 10/1964 | Ferguson | 16/151 X |
| 3,172,146 | 3/1965 | Dickinson et al. | 16/129 |
| 3,251,088 | 5/1966 | Boundy | 16/130 X |
| 3,866,658 | 2/1975 | Smith | 16/130 X |

*Primary Examiner*—Geo. V. Larkin
*Attorney, Agent, or Firm*—Olson, Trexler, Wolters, Bushnell & Fosse, Ltd.

[57] ABSTRACT

The present invention relates generally to improvements in pivot assemblies for vertically hung doors and more particularly to novel practical pivot assemblies for use with door members of the type in which the pivoted vertical edge thereof is in substantial abutting relation with a complementary vertical door frame member when said door member is in closed position. The pivot assembly disclosed herein includes door fittings for attachment to the upper and lower corner portion of a door member and door frame fittings for association with the upper and lower horizontal sections of an associated door frame. Each door fitting carries a pintle fixed at one extremity to the door fitting and at the opposite extremity to a member or plate having a polygonally shaped periphery. The polygonally shaped member is nested within a recess in the door frame fitting defined by an internal periphery adapted to cooperate with said polygonally shaped member so as to effect horizontal displacement of the door member as said member is shifted from its closed position.

5 Claims, 15 Drawing Figures

PIVOT ASSEMBLY

REFERENCE TO RELATED APPLICATION

The present application is a division of U.S. pat. application Ser. No. 449,321, filed March 11, 1974, which application is a continuation in part of U.S. patent application Ser. No. 352,878, filed Apr. 20, 1973, said latter application being abandoned.

SUMMARY OF THE INVENTION

In instances where it is essential for the pivoted vertical edge of a swingable door, when in closed position, to be located immediately adjacent the vertical surface of a complementary door frame, it is necessary to horizontally shift the door member in order to permit free swinging or movement thereof from its closed position. In installations of the type referred to, it is not practical to employ conventional door hinges and it is one of the important objects of the present invention to provide improved, novel, and very practical pivot assemblies which permit horizontal shifting or separation of the vertical pivoted edge of the door member with respect to an adjacent vertical door frame surface immediately upon swinging or shifting said door member from its closed position.

It is a further object of the present invention to provide an improved pivot assembly of the type referred to above which is adapted to be used with equal facility with doors swingable through 90° in opposite directions. This is to be distinguished from arrangements wherein pivot assemblies employed in association with a door member swingable through 90° in one direction could serve without installation modifications for use with doors swingable in the opposite direction.

More specifically, the present invention contemplates a novel pivot assembly device of extremely simple construction wherein a uniquely designed member rotatable with the door and having a polygonally shaped outer periphery cooperates with a complementally shaped internal surface defining a recess in a fixed member to effect horizontal shifting of the door member.

There is also provided a novel, adjustable vertical pintle mechanism which enables the horizontal position of the pintle to be adjusted, and thus facilitates proper alignment and mounting of the door relative to the door frame.

The present invention also comtemplates a very practical and improved pivot assembly for vertically hung door members which may be installed with a minimum amount of skill and effort.

BRIEF DESCRIPTION OF THE DRAWINGS

Referring now to the drawings more in detail wherein like numerals have been employed to designate similar parts throughout the various views, it will be seen that.

DESCRIPTION OF A PREFERRED EMBODIMENT OF THE INVENTION

Figure 1:
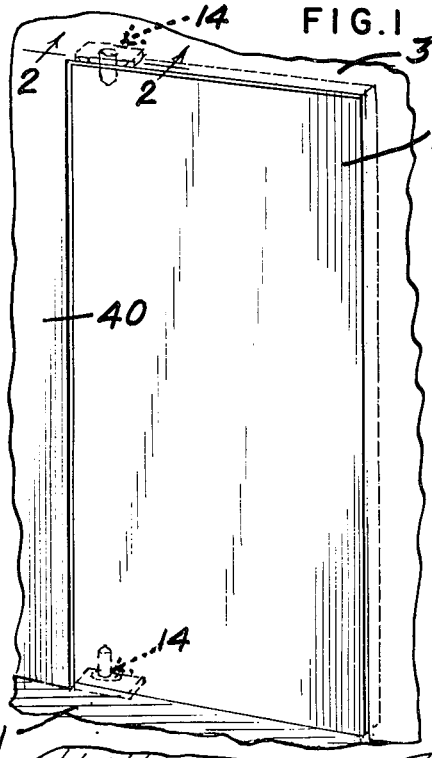
FIG. 1 discloses a vertically hung door member and associated door frame, said door member and frame being equipped with a novel pivot assembly device contemplated by the present invention.

Referring now to the drawings more in detail wherein like numerals have been employed to designate similar parts throughout the various views, it will be seen that pivot assembly devices or mechanisms which are representative of one embodiment of the present invention are designated generally by the numeral 14. Each of the pivot assemblies includes a pintle arrangement and pintle receiving mechanism which in the present instance is in the form of camming means, as will be discussed more completely hereinafter. The camming means, in conjunction with the pintle arrangement, is effective to produce lateral displacement of the door member 18 relative to the jam or frame member 40 during opening movement; and further attains this end while permitting the door to open in either direction.

Figure 3:
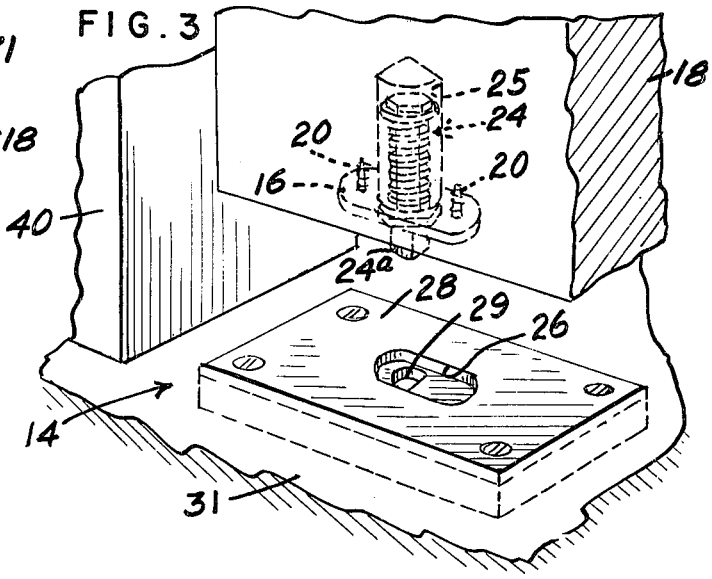
FIG. 3 is a fragmentary perspective view of the lower corner structure shown in FIG. 2, the door member being illustrated in an elevated or detached position to expose the parts of the lower pivot assembly otherwise hidden.
Figure 2:
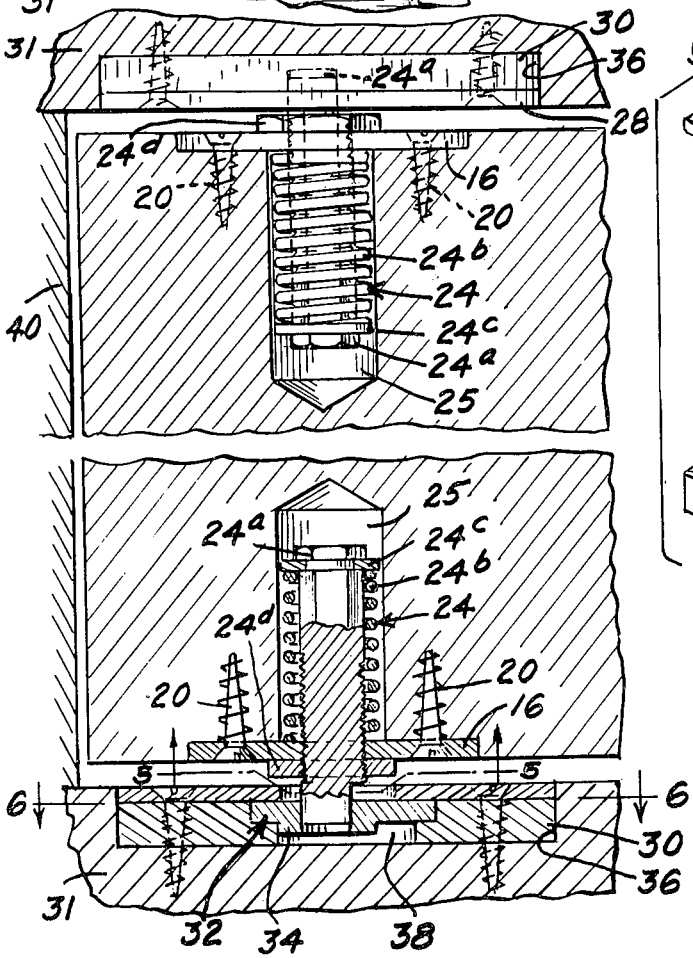
FIG. 2 is an enlarged fragmentary vertical sectional view of the upper and lower pivoted corners of the door member and associated door frame, said view being taken substantially along the line 2—2 of FIG. 1.
Figure 4:
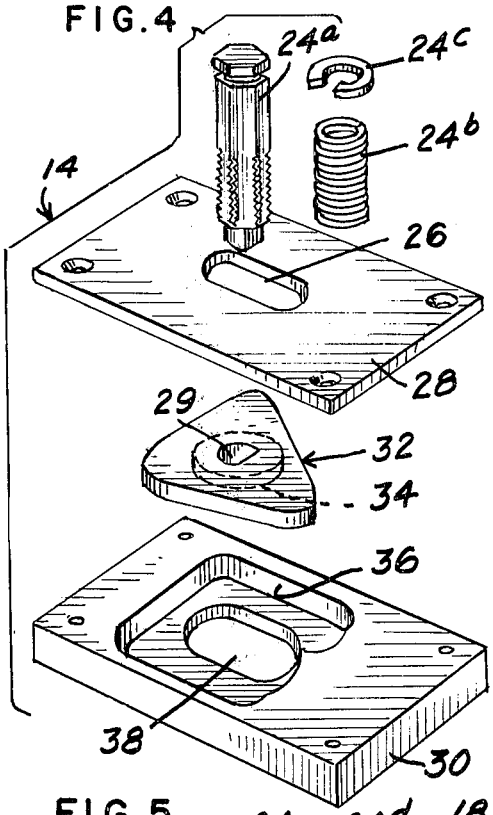
FIG. 4 is an exploded view of the elements of the pivot assembly, such as the pintle which is fixed to the door member, the slotted cover plate through which the pintle extends, the rotatable element or plate having a polygonally shaped external periphery, and the recessed base member or plate for accommodating said polygonally shaped member.
Figure 5:
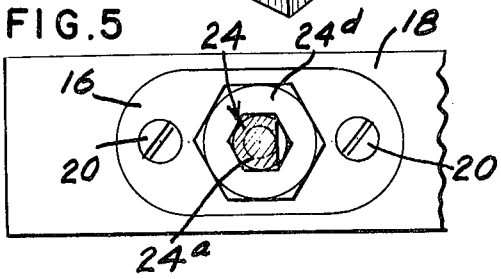
FIG. 5 is a fragmentary horizontal sectional view taken substantially along the line 5—5 of FIG. 2.

Turning now to a more detailed discussion of the pivot assemblies 14, attention is directed initially to FIGS. 2 - 4. As to the pintle arrangement, an aperture plate or bracket 16 is secured to the edge surface of the door, by means of screws 20, or the like. A vertical pintle device 24 is fixed at one extremity within each plate or bracket 16 and extends into vertical recesses 25 provided in the door member 18. The other extremity of each of the pintle devices 24 projects or extends from the surface of the plate members 16. The projecting extremity of each pintle device 24 is non-circular and is, as will be explained, accommodated by the pintle receiving camming means.

The camming means for each pivot assembly 14 is carried by the door frame 40. Each said camming means includes a plate or base member 28 having a slot 26 therein, and overlies the base member 30 to serve as a cover therefor. In addition to the base member 30 and plate 28, the camming means includes a polygonally shaped cam member 32, viz., multi-lobular, which is provided with a non-circular aperture 29 for receiving the projecting extremity of the pintle device 24, which is of a complementary shape. In addition, the cam member 32 also includes a depending, generally circular protuberance 34, the purpose and function of which will be explained hereinafter.

Each of the base members or plates 30, which are mounted within horizontal upper and lower door frame sections 31, is provided with recesses 36, FIG. 2, for accommodating the polygonally shaped cam member 32. The inner periphery of the recess 36 is complementally shaped with respect to the outer periphery of the polygonally shaped cam member 32 and defines a cam engaging surface. A shallow recess of slot 38 in the base member 30 serves to accommodate and guide the circular section 34 depending from the underside of the member 32, thus mounting the cam member 32 for rotatable, longitudinal movement relative to said base member 30.

It will be noted that each pintle device 24 includes a pintle member 24*a*, a coil spring 24*b*, a split ring washer 24*c* and a clamping nut 24*d*. The pintle members 24*a* are polygonal in cross sectional shape and are longitudinally adjustable within complementary polygonally shaped apertures within their complementary plates 16. The clamping nuts 24*d* are accommodated by complementary threads of the pintle member 24*a*. The split ring washers 24*c* are accommodated by a peripheral recess at the inner extremity of a complementary pintle member and provide a shoulder against which the upper extremity of the coil spring 24*b* may bear. By rotating the nut 24*d*, the pintle member 24*a* may be vertically adjusted within the recess 25. The coil spring 24*b* is interposed between the split ring washer 24*c* and the inner surface of the plate 16 and constantly urges the clamping side of the nut 24*d* against the external surface of the plate 16 as will be clearly understood from FIG. 2.

When the door member 18 is initially inserted within the door opening, the pintle members 24*a* must be fully retracted within the respective recesses 25. After such insertion, the nut members 24*d* may be rotated so as to cause axial projection of the pintle members into telescopic association with their respective polygonally shaped plate members 32. It will be apparent that the coil springs 24*b* also function to secure the clamping nuts 24*d* against unauthorized rotation with respect to an associated pintle member. Further, the nuts 24*d* and the adjustability afforded thereby provide an additional advantage in that the height of the door above the lower frame portion 31 can be altered. For example, the nuts 24*d* for the lower pivot assembly would be turned to increase the amount of projection of the pintle 24*a* from the plate 16; correspondingly, the pintle 24*a* for the upper assembly would be retracted.

Figure 6:
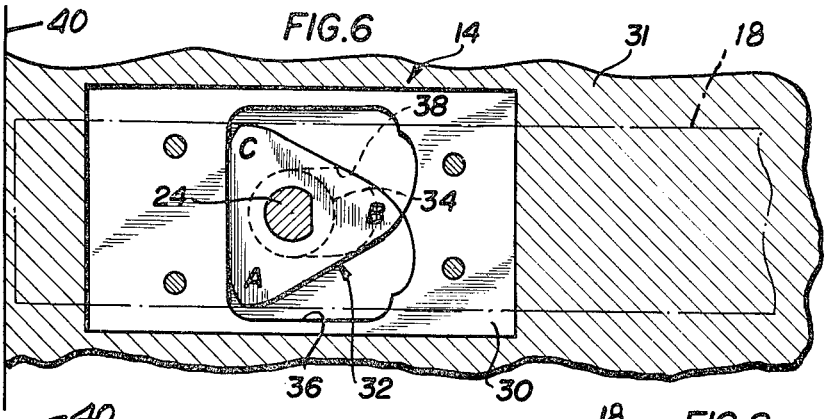
FIG. 6 is a fragmentary horizontal sectional view taken substantially along the line 6—6 of FIG. 2, the door member being illustrated by dot and dash lines in its closed position.

From the foregoing, it should be understood that when the door member 18 occupies its closed position as illustrated in FIG. 6, the apices or lobes on the cam member 32 identified by the letters A, B and C occupy the position shown in FIG. 6. In this position the apex or lobe B of the cam member 32 engages the midpoint of the internal surface portion defining the right side of the recess 36 as viewed in FIG. 6, and the oppositely disposed peripheral portion defining the recess 36 is engaged by the periphery of the polygonally or triangularly shaped cam member 32 oppositely disposed from the lobe B. With the cam member 32 thus disposed within the recess 36, the door member 18 is maintained in its normal closed position and in this position the pivoted vertical edge of the door is located closely adjacent the surface of the vertical door frame section 40. As the door member 18 is shifted or swung in a counter clockwise direction as viewed in FIGS. 6 to 9 inclusive, the apices or lobes A, B and C maintain contact with complementary surface areas of the internal periphery which defines the recess 36. The pintle 24 being non-rotatably coupled with the triangular cam member 32 causes said cam member to be rotated through the various angles of displacement indicated in FIGS. 7 to 9 inclusive. FIG. 9 discloses the relative positions of the apices A, B and C with respect to the peripheral surface defining the recess 36 when the door member 18 is in fully open position.

Figure 11:
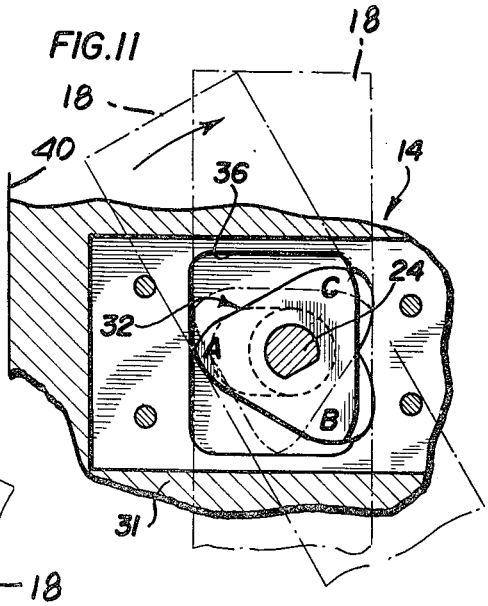
FIG. 11 discloses the door member shifted in a clockwise direction through an angle of 60°.
Figure 10:
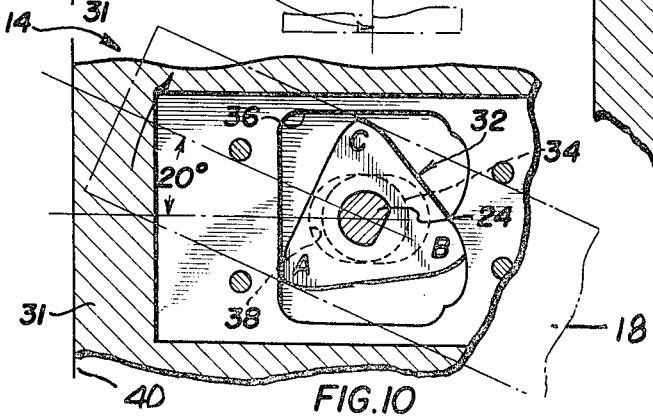
FIG. 10 is a view similar to FIGS. 7 to 9 inclusive disclosing the door member after having been shifted in a clockwise direction through 20°.

FIGS. 10 and 11 illustrate the relative positions of the moving parts when the door member is shifted in a clockwise direction. FIG. 10 discloses the door member shifted through 20°. The solid line position of the polygonal or triangular member 32 illustrates the relative positions of the parts when the door member is shifted through 60° in a counter clockwise direction. The dot and dash line position of the member 32 in FIG. 11 illustrates the relative positions of the parts when the door member has been shifted in a clockwise direction to its full open position.

It should be noted here that one of the extremely advantageous features of the present invention, in addition to its simplicity of construction, is the fact that it affords bi-directional operation of the door. That is to say, special constructions are not needed for left and right hung door, or for bi-directional doors.

Figure 7:
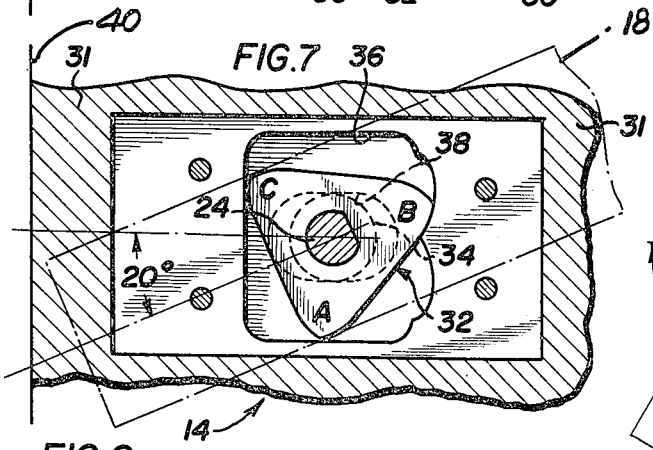
FIG. 7 is a view similar to FIG. 6 disclosing the door member shifted in a counter clockwise direction through an angle of 20°.

It will be understood from the foregoing description that as the door opens the polygonally or triangularly shaped cam member 32 begins to rotate from the position shown in FIG. 6 to the position illustrated in FIG. 7. This rotative movement will bring the lobe C into engagement with the camming surface 36, and due to the eccentric nature of the cam member 32, this engagement produces a movement of the cam 32 longitudinally of the slot 38. This movement, in turn, produces a lateral displacement of the vertical pivoted edge of the door member away from the adjacent surface of the vertical door frame 40. This immediate horizontal shifting of the door member as it is swung from its closed position assures the required clearance between the vertical edge of the door and the adjacent surface of the vertical door frame section 40. This is essential, as the pivoted edge is closely spaced with respect to said frame in the closed condition.

Figure 8:
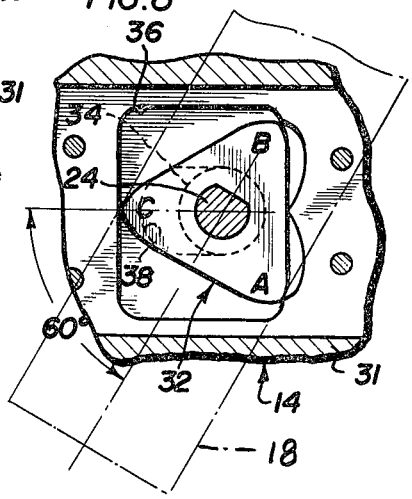
FIG. 8 is a view similar to FIG. 7 illustrating the door member shifted in a counter clockwise direction through an angle of 60°.
Figure 9:
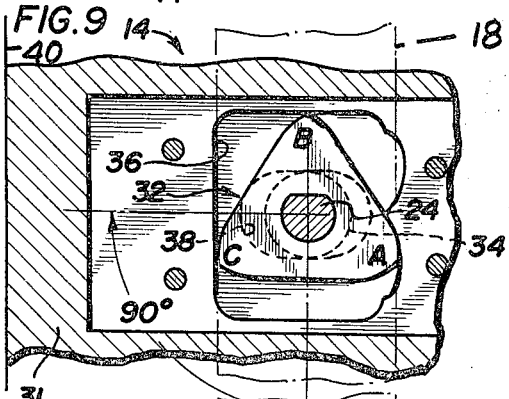
FIG. 9 is a view similar to FIGS. 7 and 8 disclosing the door member shifted to its completely open position after having been shifted in a counter clockwise direction through an angle of 90°.

Continued opening movement will rotate the cam member 32, as illustrated in FIGS. 7 – 9, with maximum lateral displacement being attained when the door has opened through an angle of 60°; as shown in FIG. 8. With reference to FIG. 9, the door is fully opened, and it can be seen that the lobe A has come into contact with the scalloped portion of the camming surface 36. This causes the cam member 32 to move back toward initial position.

During closing, the sequence of operation is reverse, from that as discussed above; that is, the sequence is now from FIGS. 9 – 6. It should be noted in this regard, that as the door closes, the lobe portion B will be brought back into engagement with the scalloped portion of surface 36. This engagement produces a force tending to move the cam member 32 back toward its initial position, as shown in FIG. 6. Thus, during closing, there is provided a positive return action that will place the door edge into closely spaced relation with the door frame 40.

When the door is operated in clockwise direction, the sequence of operation is as shown in FIGS. 10 and 11. In this regard, the lobe A is brought into engagement with the camming surface 36, to produce the desired initial lateral displacement. The operation during further opening movement, and closing is essentially the same as described above.

Turning now to FIGS. 12 – 15, an additional feature of the present invention is disclosed, namely an adjustable mounting bracket for the pintle mechanism to be employed with the upper door portion. In this regard, previously described components will be designated by the same reference characters, with the addition of a prime (′).

Figure 12:
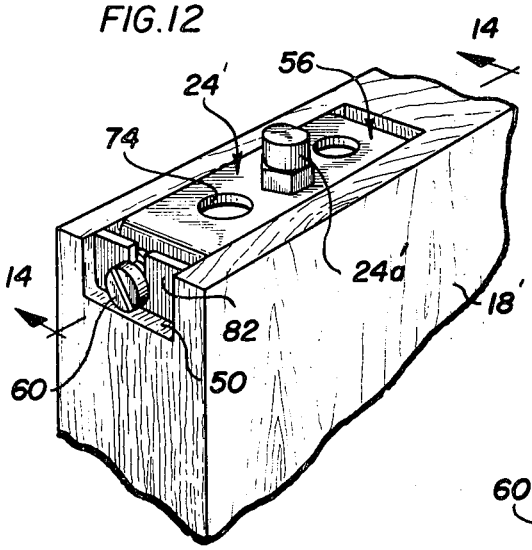
FIG. 12 is a partial perspective view of the novel, adjustable pintle mechanism mounted to the upper edge surface of a door.
Figure 12:
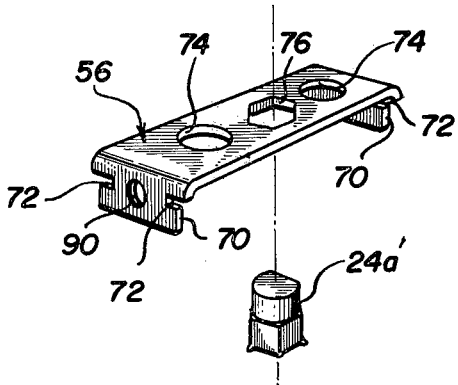

As will be apparent from the following description, pintle mechanism 24′ of FIG. 12 can be employed with the cam type mechanism discussed previously, or with other conventional pivot assemblies. The primary feature of the pintle arrangement 24′ is its adjustability which aids initial assembly and subsequent plumbing of the door, as will be explained.

Figure 13:
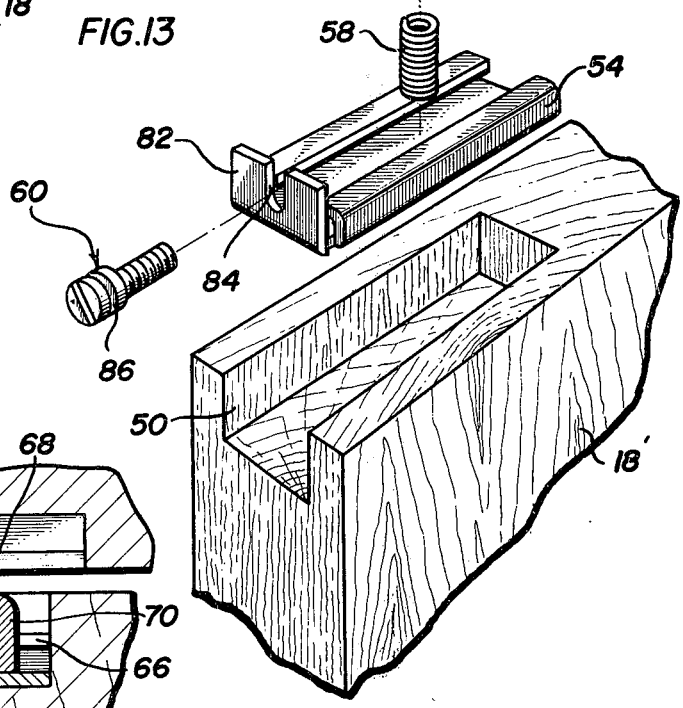
FIG. 13 is an exploded perspective of the pintle mechanism of FIG. 12.
Figure 14:
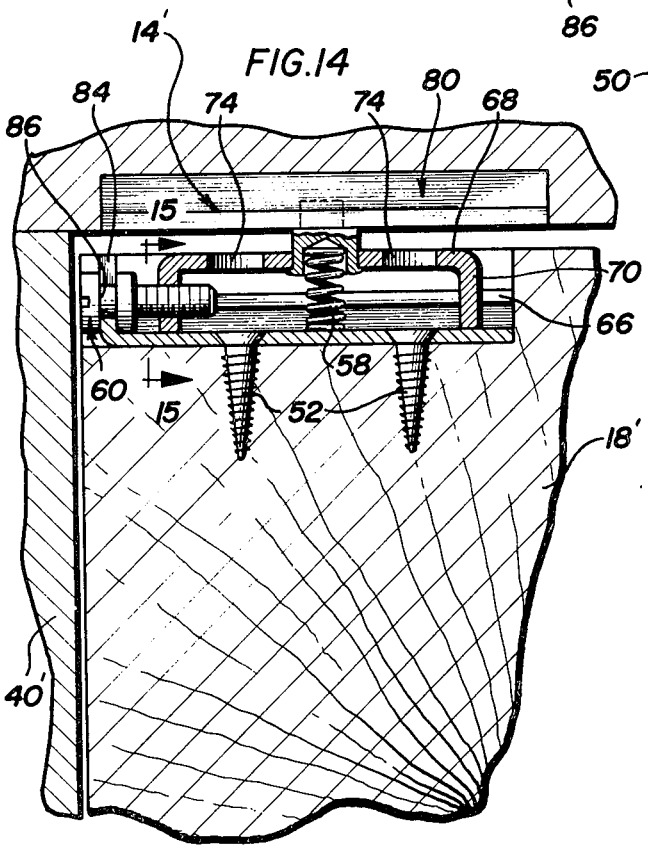
FIG. 14 is a vertical sectional view, similar to the upper portion of FIG. 2, and taken along a plane parallel to the plane of the door, and further illustrating the pintle engaged with the stationary mounting plate assembly affixed to the door frame.

Looking now to FIGS. 12 – 15, the door member 18′ is provided with a slot or cut-out 50 within which the pintle arrangement 24′ is mounted, by screw members 52, FIG. 14. As can be seen from the exploded representation of FIG. 13, the pintle arrangement 24′ includes a trough or channel shaped base member 54, a slide member 56 which is carried by base member 54, a pintle device **24*a*′, a biasing means in the form of a spring 58 and a drive screw 60.**

Figure 15:
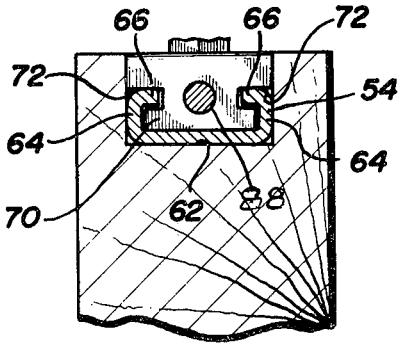
FIG. 15 is a vertical section view taken along the line 15—15 of FIG. 14.

The base member 54, as best seen in FIG. 15, has a generally u-shaped cross section. As such, there is provided a bight portion 62, and a pair of spaced, upstanding, parallel side flanges 64 integral with the bight portion 62. Each side flange 64 has the free edge thereof turned inwardly, to provide a pair of elongated guide tracks 66.

The slide member 56, best seen in FIG. 13, is also u-shaped and includes a generally planar bight section 68, and a pair of down-turned end flanges 70. End flanges 70 are notched at 72, to provide for acceptance of the guide rails 66, as shown in FIG. 15. The planar upper bight surface includes a pair of apertures 74 which enables a tool to be employed in driving home the screws 52. Further, there is provided an additional aperture 76 of non-circular configuration, which accommodates the pintle device **24*a*′.**

Looking to FIG. 14, in conjunction with FIG. 13, it can be seen that the pintle device **24*a*′ includes a first generally hexagonal portion which is received in the correspondingly shaped aperture 76. This engagement produces a non-rotatable coupling of the pintle device 24*a*′ to the slide member 56. The upper most portion of the pintle device 24*a*′ is also non-circular, and is adapted to be received by the element of the pivot assembly carried by the door frame, and designated 80 in FIG. 14. The spring 58 maintains the pintle device 24*a*′ in an extended condition, relative to the surface 68 of slide member 56.**

With reference to the preceding paragraph, the element 80 of the pivot assembly 14′ of FIGS. 12 – 15 may be similar to the camming mechanism as discussed with regard to FIGS. 1 – 11. That is, there may be employed a camming surface and a cam member to which the pintle device **24*a*′ is coupled, which cooperate to produce lateral displacement of the door 18′. Or alternately, the element 80** may be of more conventional construction.

In addition to the aforediscussed channel shaped segment of the base member 54, said member also includes a drive screw mounting flange 82. Flange 82 is notched at 84, and the drive screw 60 is provided with a groove 86 in the head portion thereof, so that said head portion can be engaged with the notch 84, as shown in FIG. 14. The drive screw 60 further includes a threaded portion 88 which is engaged in a correspondingly threaded aperture 90 in one of the end flanges 70 of the slide member 56.

Accordingly, from the above it can be seen that the drive screw 60 is rotatably mounted to the flange 82. Upon rotation of said screw 60, the slide member 56 will be moved longitudinally of the base member 54. Thus, the position of the projecting portion of the pintle device **24*a*′** may be altered as needed.

With the above in mind, it should be noted that once the bottom pivot assembly is engaged, the adjustable feature afforded by the pintle mechanism 24′ of this invention aids considerably in completion of the assembly operation. In this regard, even if the pintle receiving device 80 has not been aligned properly, the position of the pintle **24*a*′ can be adjusted to accommodate any misalignment. Once fully assembled, the adjustable pintle mechanism 24′ can be used to plumb the door and bring the pivoted edge thereof into close position with relation to the door frame 40′.**

From the foregoing description, it will be apparent that the present invention contemplates extremely simple yet practical pivot assemblies which may be installed with a minimum amount of effort and skill. It will also be apparent that the above-described pivot assembly 14 may be used for both the upper and lower corners of the door member, and said door member may be shifted through 180° without requiring any installation modifications. Certain types of available pivot assemblies require different installation modifications depending upon the direction in which the door member is to be swung. Applicant's device as disclosed herein permits the door to be shifted or swung in opposite directions without any alteration or rearrangement of the parts forming the pivot assembly. The design of the above described pintle assembly 14 is such as to permit axial adjustment of the pintle members. This axial adjustment facilitates initial installation of the door and also enables vertical adjustment to accommodate variations in the height of the door opening.

While a specific structural embodiment of the present invention has been illustrated and described herein, it should be appreciated that other modifications and changes are contemplated hereby and the present invention should only be limited by the spirit and scope of the appended claims.

The invention is claimed as follows:

1. An adjustable pintle arrangement for a door pivot assembly of the general type wherein a pintle device is carried by a door member and pintle accommodating means is mounted to the door frame, said adjustable pintle arrangement comprising, a base member mountable to the door member in a relatively fixed position, a slide member carried by said base member for longitudinal movement relative thereto, drive means mechanically inter-connecting said slide member and base member for producing controlled longitudinal movement of said slide member relative to said base member, and a pintle device carried by said slide member and projecting therefrom, such that operation of said drive mechanism will produce relative longitudinal movement of said pintle device with respect to said base member, said slide member including an aperture formed therein, said pintle device being disposed in said aperture, and spring means biasing the said pintle device outwardly of said slide member so as to project from the upper surface thereof.

2. An adjustable pintle device as defined in claim 1, wherein said aperture formed in said slide member is of a non-circular configuration, and said pintle device including a similar shaped portion adapted to be disposed in said aperture to preclude rotation of said pintle device relative to said slide member.

3. An adjustable pintle arrangement for a door pivot assembly of the general type wherein a pintle device is carried by a door member and pintle accommodating means is mounted to the door frame, said adjustable pintle arrangement comprising, a base member mountable to the door member in a relatively fixed position, a slide member carried by said base member for longitudinal movement relative thereto, drive means mechanically inter-connecting said slide member and base member for producing controlled longitudinal movement of said slide member relative to said base member, and a pintle device carried by said slide member and projecting therefrom, such that operation of said drive mechanism will produce relative longitudinal movement of said pintle device with respect to said base member, said base member being of an elongate channel-like configuration, including a bight portion and a pair of spaced generally parallel side wall portions formed integral with said bight portion and terminating in inwardly turned flange segments which provide a pair of elongate guide rails, said slide member including a pair of spaced, down-wardly turned end flanges, each said end flange being notched on opposite edges thereof to receive said guide rails, whereby said slide member may be moved longitudinally of said base member along said guide rails.

4. A pintle arrangement as defined in claim 3, wherein said channel-like base member further includes an upturned mounting flange member and said drive means comprises a screw member rotatably carried by said upturned flange, a threaded aperture formed in an adjacent end flange of said slide member in receiving therein enthreaded engagement, the threaded portion of said screw member, such that rotation of said screw member will produce longitudinal movement of said slide member relative to said base member.

5. An adjustable pintle arrangement for a door pivot assembly of the general type wherein a pintle device is carried by a door member and pintle accommodating means is mounted to the door frame, said adjustable pintle arrangement comprising, a base member mountable to the door member in a relatively fixed position, a slide member carried by said base member for longitudinal movement relative thereto, drive means mechanically inter-connecting said slide member and base member for producing controlled longitudinal movement of said slide member relative to said base member, and a pintle device carried by said slide member and projecting therefrom, such that operation of said drive mechanism will produce relative longitudinal movement of said pintle device with respect to said base member, said base member including one or more fastener elements accommodating recesses enabling attachment of said base member to a door member, and said slide member including a corresponding number of apertures in the upper surface thereof to provide for engagement of said fastener elements by a drive tool.

* * * * *